US005829197A

United States Patent [19]

Oh

[11] Patent Number: 5,829,197

[45] Date of Patent: Nov. 3, 1998

[54] MANUALLY ACTUABLE APPARATUS ENABLING A DOOR TO BE SELECTIVELY HINGED AT EITHER SIDE

[75] Inventor: Gil-Soo Oh, Suwon, Rep. of Korea

[73] Assignee: Samsung Electronics Co., Ltd., Suwon, Rep. of Korea

[21] Appl. No.: 685,018

[22] Filed: Jul. 22, 1996

[30] Foreign Application Priority Data

Dec. 2, 1995 [KR] Rep. of Korea ..... 95-46193
Dec. 7, 1995 [KR] Rep. of Korea ..... 95-47351

[51] Int. Cl.[6] ..... E05D 15/50

[52] U.S. Cl. ..... 49/193; 49/382

[58] Field of Search ..... 49/193, 382; 105/281; 16/231

[56] References Cited

U.S. PATENT DOCUMENTS 3,403,473 10/1968 Navarro ..... 49/193
4,503,582 3/1985 Gurubatham ..... 49/193
4,947,583 8/1990 Inui et al. ..... 49/193
5,548,927 8/1996 Song ..... 49/193

FOREIGN PATENT DOCUMENTS 1508620 1/1968 France ..... 49/193

*Primary Examiner*—Jerry Redman
*Attorney, Agent, or Firm*—Burns, Doane, Swecker & Mathis, L.L.P.

[57] ABSTRACT

A door is mounted on a refrigerator body by a mechanism enabling the door to be opened selectively at either side thereof while the other side forms a hinge. The mechanism includes a pair of hinge pins disposed on opposite sides of either the body or the door, and a pair of pin slots carried by the other of the body and door for receiving respective ones of the hinge pins when the door is closed. Pin grippers are mounted adjacent respective slots, and each pin gripper is movable between a release state permitting a respective pin to enter and leave its respective slot, and a retaining state preventing the respective pin from leaving its respective slot. A latch bar is manually slidable between first and second positions for holding one of the pin grippers in its retaining state while releasing the other pin gripper.

11 Claims, 7 Drawing Sheets

MANUALLY ACTUABLE APPARATUS ENABLING A DOOR TO BE SELECTIVELY HINGED AT EITHER SIDE

BACKGROUND OF THE INVENTION

1. Field of the Invention

The present invention relates to a device for enabling a door to be selectively hinged at either side, and a refrigerator equipped with such a device.

2. Prior Art

A door is an essential component in buildings such as a house, in furniture or in household appliances such as microwave ovens and refrigerators. A conventional door has a hinge at either the left or the right side and a knob provided at the other side, and is normally designed to be opened or closed at one side of the door only. As a consequence, such a door may be inconvenient to a user—who can be right-handed or left-handed—depending on the side on which the knob is provided.

Furthermore, the opening direction of the door, when selecting a place for installing an appliance with a door, could limit the choices and thus reduce the effective utilization of available space.

To eliminate the above described shortcomings, several patents including European Patent Publication No. 0 501 021, U.S. Pat. No. 3,889,419, U.S. Pat. No. 4,503,582, U.S. Pat. No. 4,503,583 and U.S. Pat. No. 5,064,255 present several kinds of devices for selectively opening/closing a door at either side thereof.

The above conventional devices for opening/closing a door utilize a relatively complicated mechanism in order to freely open/close a door from either side. In these devices, when a user pulls one side of the door, the door is opened in the pulling direction while the other side of the door functions as a hinge.

Furthermore, in conventional devices for opening/closing a door at either side, a large number of precise parts are combined in order to secure the exact switching of either side to the hinged state and to prevent the separation of the door from the appliance body when the door is opened. As a result, the manufacturing cost of the device is relatively expensive, and the device has a high possibility of a breakdown, failing to guarantee safe operation when the size of the parts lose their original precision or when the parts wear out with time.

SUMMARY OF THE INVENTION

The invention has been conceived to overcome the above problems in the prior art, and accordingly it is an object of the invention to provide a device for opening/closing a door at either side and which only one desired side of the two sides of a door can be opened according to the user's choice of direction (activated by a latch), and which can be manufactured at a low cost and with relative ease.

It is the second object of this invention to provide a refrigerator equipped with the above described device for opening/closing a door at either side.

The above objects are realized by a device for opening/closing a door installed at a door opening of the appliance's main body comprising at least one pair of hinge pins opposing each other at opposite ends of either the door or the main body, the hinge pins serving as pivot shafts for the door; a casing fixed to either the door or the main body, whichever is not used above, the casing having pin slots to allow access to the hinge pins; a pair of pin gripper means placed in the region of each of the pin slots, the pair of pin gripper means being movable between a retaining position and a release position, the pin gripper means blocking the pin slots from the release direction so as to restrain the hinge pins in the pin slots at the retaining position, and the pin gripper means permitting the hinge pins to be released from the pin slots at the release position; a latch means for retaining one of the two pin gripper means at the release position and the other pin gripper means at the retaining position; and a switching knob for operating the latch means from the exterior.

The latch means may be a bar-like latch member; it is positioned so that it can slide between the two gripper means and has opposite distal ends to selectively come into contact with the gripper means. The device could further comprise a retaining means for fixing the latch member. The retaining means may comprise a holding protuberance bulging out of the latch member and a retaining member fixed to the casing, the retaining member being elastically deformable and having retaining grooves with which the holding protuberance engage.

According to a preferred embodiment, the pin gripper means comprises a pin gripper having a pin receiving groove for partially accommodating the hinge pin and pivoting between the retaining position and the release position and a spring for urging the pin gripper toward the release position, and the latch means selectively prevents one of the pin grippers from pivoting from the retaining position toward the release position. In this case, the latch means may be a bar-like latch member designed to slide between the two pin grippers, and the pin grippers may respectively have an engaging face for engaging with the corresponding ends of the latch member to be prevented from pivoting.

According to another preferred embodiment, the pin gripper means comprises a pair of pin grippers arranged in the region of each of the pin slots and springs for urging the pin grippers toward the retaining position, the pair of pin grippers having inclined surfaces in both directions so as to slide between the retaining position and the release position in cooperation with the movement of the hinge pins into and out of the pin slots, and the latch means urges to maintain one of the pin grippers at the retaining position. In this case, the latch means may be a bar-like latch member designed to slide between the two pin grippers, and the distal ends of the latch member urge pin grippers to be maintained.

Meanwhile, in another scope, the present invention further provides a refrigerator with the above mentioned device for opening/closing a door.

BRIEF DESCRIPTION OF THE DRAWINGS

The present invention will be better understood and its various objects and advantages will be more fully appreciated with the following description taken in conjunction with the accompanying drawings in which.

DETAILED DESCRIPTION OF THE PREFERRED EMBODIMENTS

Hereinafter, the present invention will be described in detail with reference to the drawings.

Figure 1:
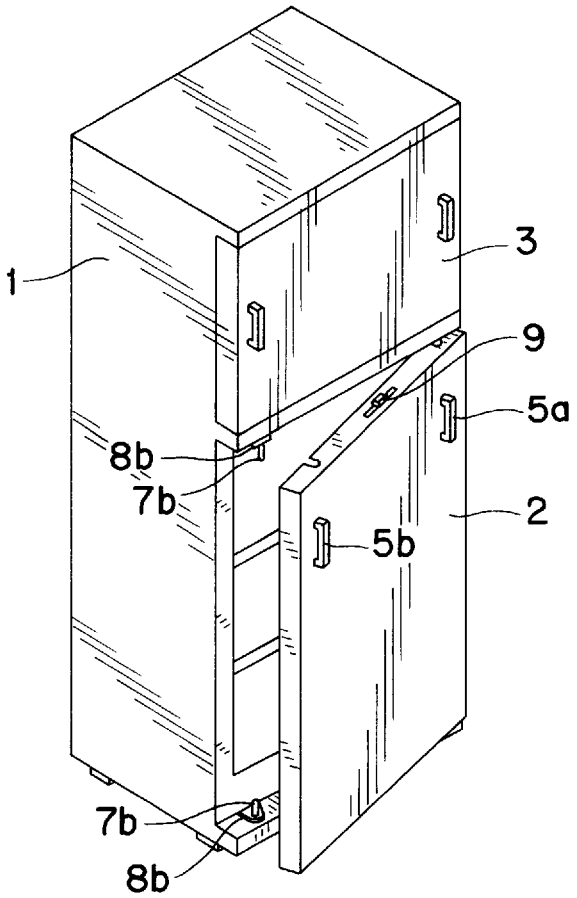
FIG. 1 is a perspective view of a refrigerator with a device for opening/closing a door according to the present invention.

FIG. 1 is a perspective view of a refrigerator equipped with a device for opening/closing a door according to this invention. The refrigerator includes a main body 1 having a fresh food compartment and a door 2 for opening/closing an opening at the front surface of the main body 1. A separate upper door 3 is accommodated for the freezer compartment located above the fresh food compartment. The door 2 is slightly opened in FIG. 1, and two door knobs of handles 5*a* and 5*b* are arranged at the left side and the right side of the door 2 for opening the door 2 from either side.

A vertically extending hinge pin is located at each and every corner of the fresh food compartment. FIG. 1 shows the left upper and lower hinge pins 7*b* among others. Each of the hinge pins 7*b* is fixed to a bracket 8*b* and protrudes from the main body 1. A switching knob 9 for selecting the opening direction of the door 2 is provided at the upper edge of the door 2. The switching knob 9 is located on the upper edge of the door 2.

Figure 2:
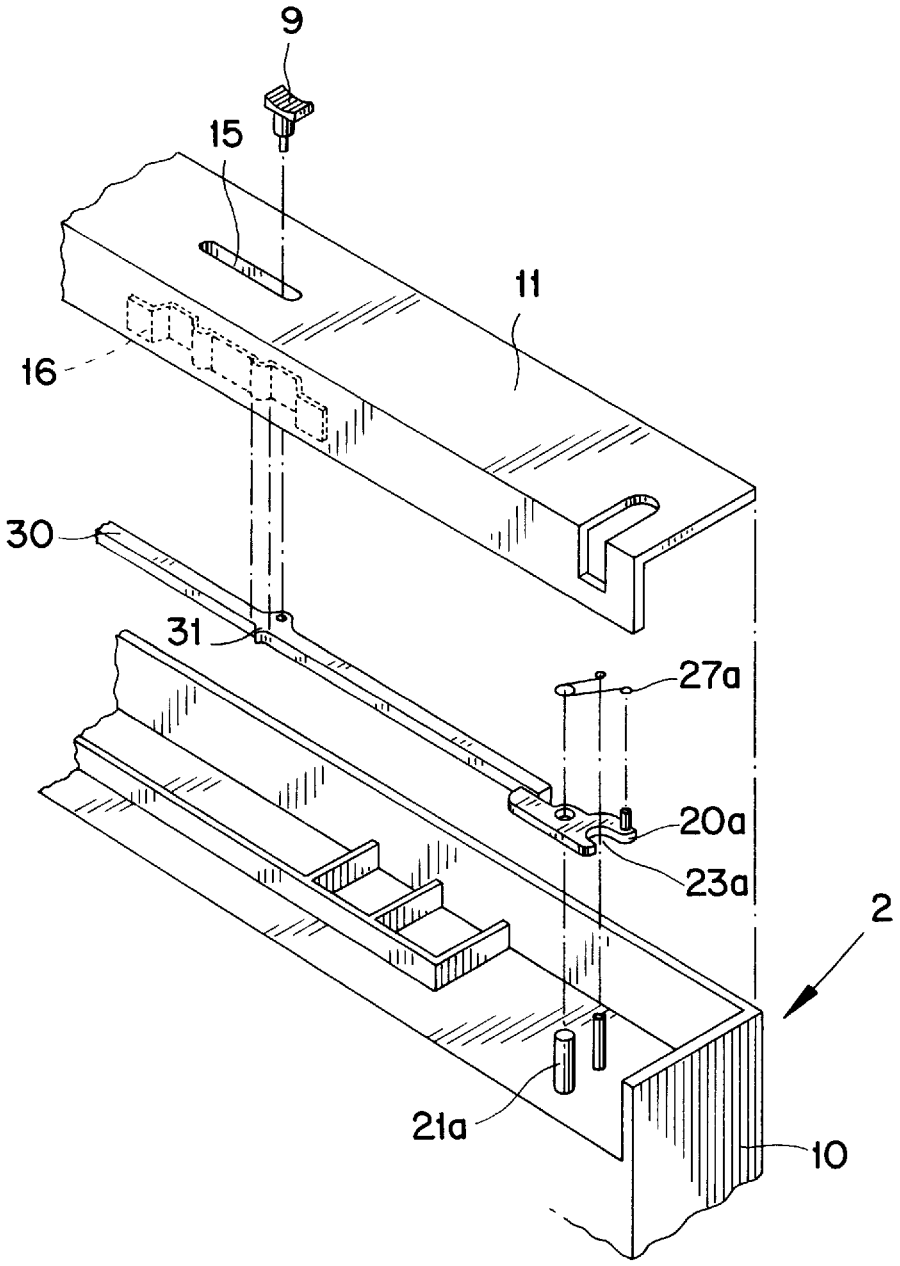
FIG. 2 is a partly exploded perspective view of a device for opening/closing a door according to a first embodiment of the invention.

FIG. 2 is a partly exploded perspective view of a device for opening/closing a door installed at an upper end of the door 2 according to the first embodiment of the present invention, an identical device being installed at the lower end of the door.

As shown in the figures, the device for opening/closing a door at either side includes a casing 10 fixed to the upper edge (or the lower edge) of the door 2 and covered by a cover 11. The casing 10 has pin slots 13*a* and 13*b* positioned near the opposite ends of the casing 10, so that corresponding hinge pins 7*a* and 7*b* of the main body 1 may come in and out of the pin slots 13*a* and 13*b*. The cover 11 has a knob slot 15 formed in the middle and elongated longitudinally. The switching knob 9 moves along the knob slot 15.

Pin grippers 20*a* and 20*b* are arranged in the region of respective pin slots 13*a* and 13*b*. The pin grippers 20*a* and 20*b* have pin receiving grooves 23*a* and 23*b* for accommodating and restraining hinge pins 7*a* and 7*b* in the pin slots 13*a* and 13*b*. The pin grippers 20*a* and 20*b* can pivot about respective pivot pins 21*a* and 21*b*.

Figure 3:
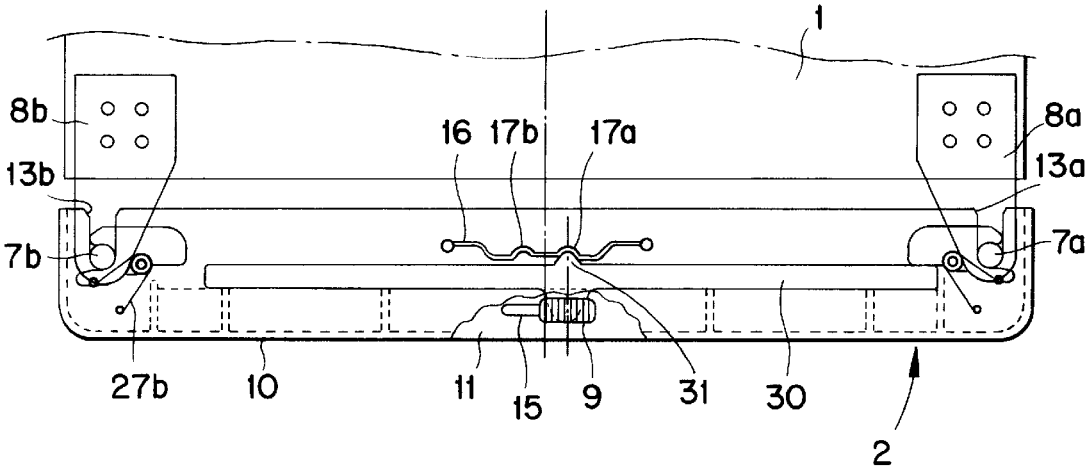
FIG. 3 is a plan view of the device for opening/closing a door illustrated in FIG. 2 in the closed state in which the right side of the door is latched.
Figure 4:
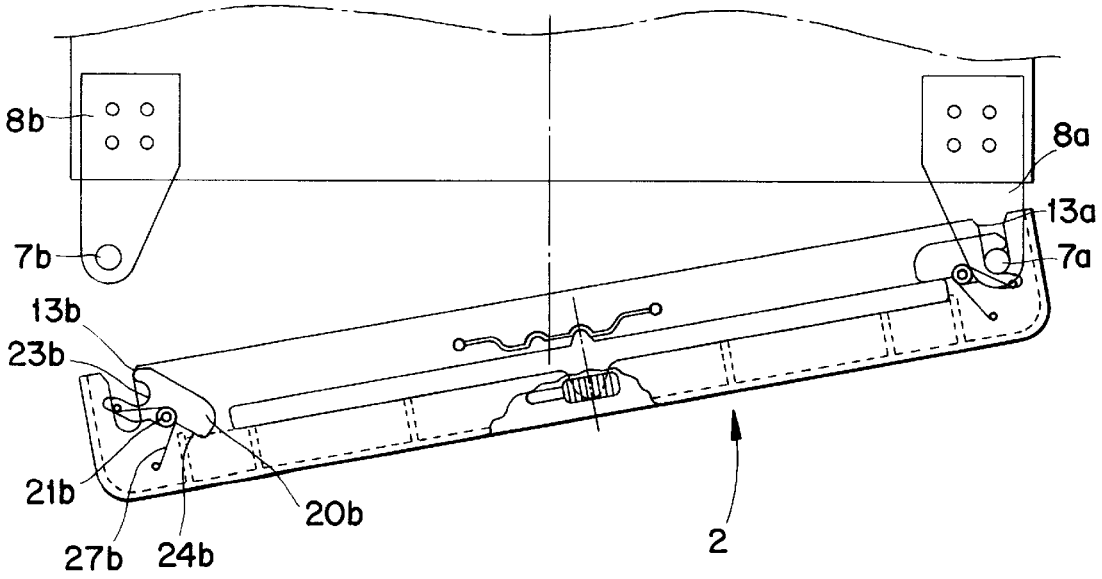
FIG. 4 is a plan view similar to FIG. 3 when the door in is opened.
Figure 6:
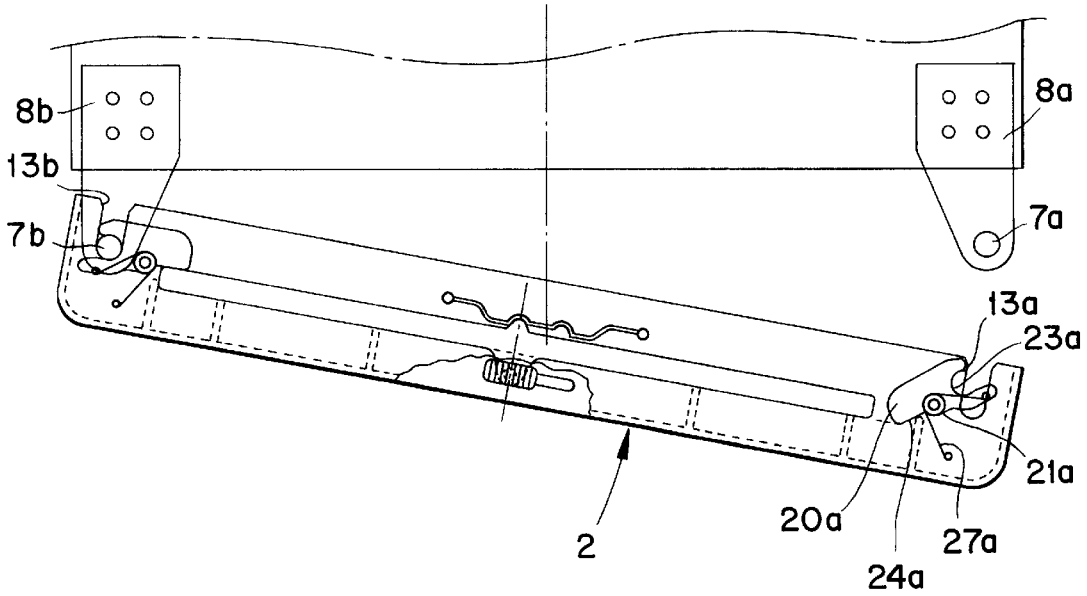
FIG. 6 is a plan view similar to FIG. 5 when the door in FIG. 5 is opened.

Therefore, a retaining state in which the hinge pins 7*a* and 7*b* are restrained in the pin slots 13*a* and 13*b*, as shown in FIG. 3, can be switched to a release state where the hinge pin 7*b* is separated and released from the pin slot 13*b*, as shown in the left side of FIG. 4, when the pin gripper 20*b* pivots. The retaining state is maintained when the hinge pins 7*a* and 7*b* come into the pin slots 13*a* and 13*b* again, as shown in FIG. 3. FIG. 6 shows the case where the right-hand pin 7*a* is separated from the pin slot 13*a*.

The pin grippers 20*a* and 20*b* are urged elastically and pivotally by pivot springs 27*a* and 27*b* so that the pin receiving grooves 23*a* and 23*b* face the pin slots 13*a* and 13*b* and wait to receive the hinge pins as shown in the left part of FIG. 4. Thus, in FIGS. 3–4 the hinge pin 7*b* can easily come into the pin receiving grooves 23*b* of the pin grippers 20*a* and 20*b* when the door 2 is switched from the opened state to the closed state. Then, the pin gripper 20*b* pivots toward a retaining position at which it restrains the hinge pin 7*b* by the force of the hinge pin 7*b* coming into the pin slot 13*b* when the door is closed. The pin gripper 20*b* is pivotal toward a release position at which it waits to receive the hinge pin 7*b*, by the force of the hinge pin 7*b* coming out of the pin slot 13*b* when the door is opened.

A latch member 30 having a long bar shape is positioned between the pin slots 13*a* and 13*b* and can slide in its longitudinal direction. The latch member 30 is connected through the knob slot 15 to the switching knob 9 which is exposed to the user, so that it can be slid by operating the switching knob 9.

The latch member 30 further includes a holding protuberance 31 protruding transversely therefrom. A retaining member 16 is fixed to the casing 10, and the retaining member 16 has two retaining grooves 17*a* and 17*b* in order to receive the holding protuberance 31. The retaining member 16 is made of an elastic material having a plate shape.

When the latch member 30 is moved longitudinally by switching the direction knob 9, the retaining member 16 is elastically deformed, so that the holding protuberance 31 of the latch member 30 can be selected to be accommodated in one of the two retaining grooves 17*a* and 17*b*. The retaining member 16 yieldably prevents the latch member 30 from moving.

When the latch member 30 is moved to the left or to the right by shifting the switching knob 9 while the door 2 is closed, the holding protuberance 31 is accommodated in one of the retaining grooves 17*a* and 17*b*, and accordingly the opposite distal ends of the latch member 30 are engaged with the engaging face 24*a* or 24*b* of the left or the right pin gripper 20*a* or 20*b*.

FIG. 3 shows the state in which the latch member 30 is moved to the right to contact with the engaging face 24*a* of the right pin gripper 20*a* receiving the pin 7*a*. In this case, the right pin gripper 20*a* can not pivot to the release position from the state in which it restrains the hinge pin 7*a* in the pin slot 13*a*. In the mean time, the left pin gripper 20*b* can pivot freely, and thereby the hinge pin 7*b* can move into and out of the pin slot without hindrance. That is, the right side of the door 2 continues to maintain the hinge state, while the left side of the door 2 can be freely opened and closed. Therefore, the left side of the door 2 can be switched between the closed state as shown in FIG. 3 and the opened state as shown in FIG. 4, while the right side functions as only a hinge.

Figure 5:
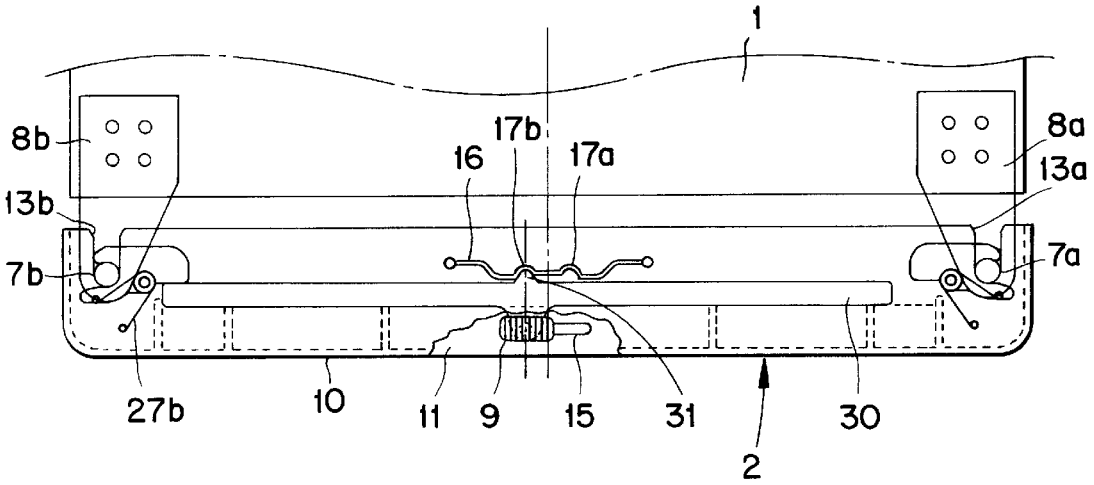
FIG. 5 is a plan similar to FIG. 3 illustrated in at the closed state in which the left side of the door is latched.

FIGS. 5 and 6 show the open state and the closed state in which the latch member 30 is moved to the left and then the left pin gripper 20*b* is latched by it. In this case, inversely to the case of FIGS. 3 and 4, the right side can be freely opened or closed, while the left side safely functions as a hinge.

As can be seen from the above described construction, a user can choose a desired opening direction by moving the latch member 30 by means of the switching knob 9 toward the desired hinge side of the door. When the door is opened, the pin gripper is held at the pivoted position at which it waits to receive the pin, and thereby the latch member can not then be moved toward the opened side and can not be engaged with the engaging face of the pin gripper. Thus, the latch at the side serving as a hinge can not be released, and accordingly the hinge can be securely prevented from being released when the door is opened.

Figure 7:
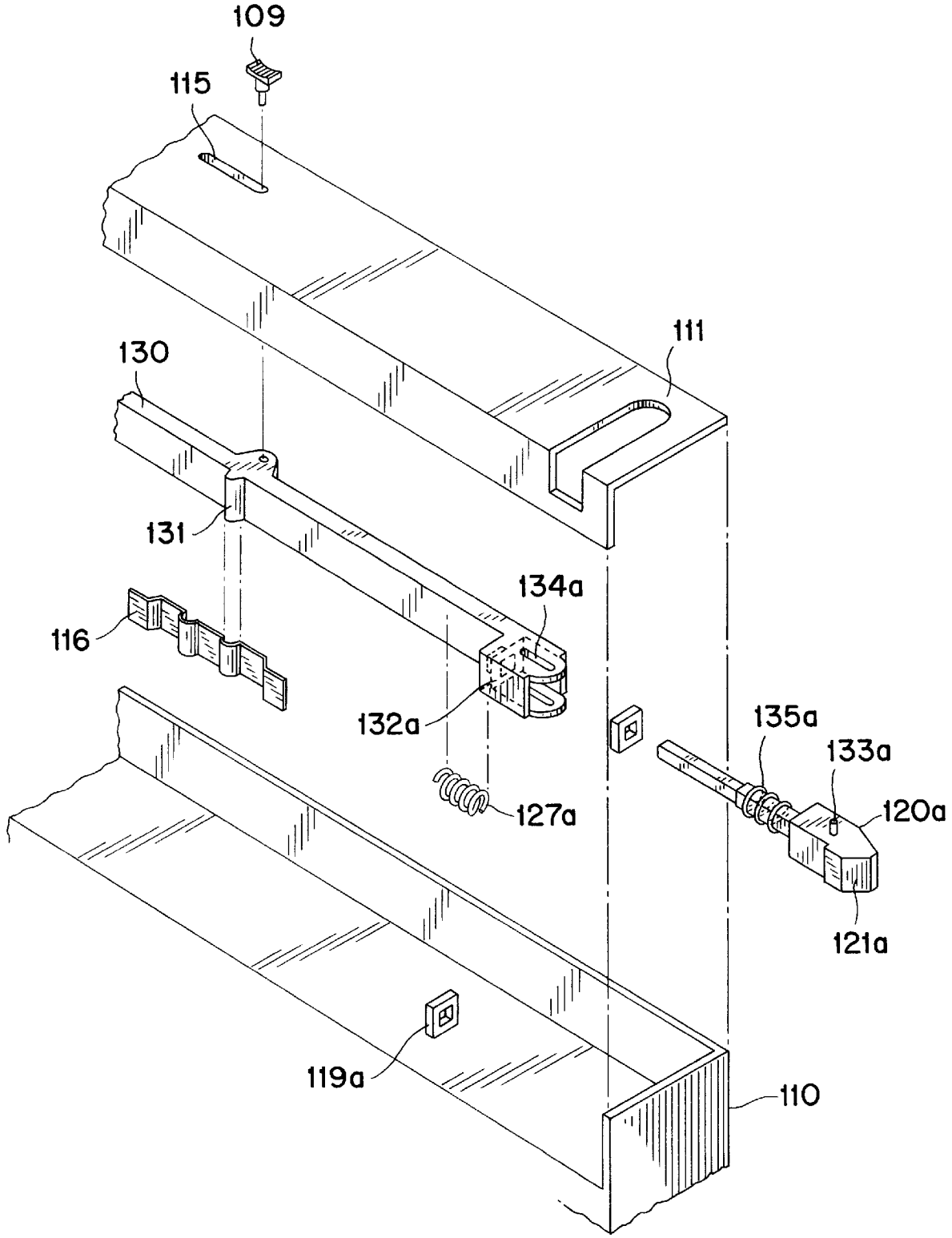
FIG. 7 is a partly exploded perspective view of a device for opening/closing a door according to a second embodiment of the invention.
Figure 8:
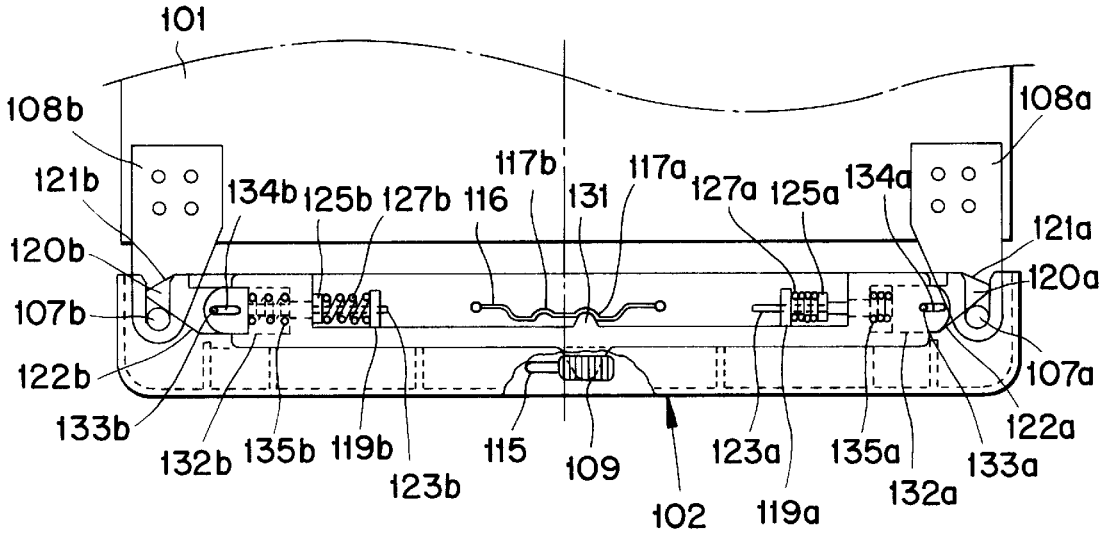
FIG. 8 is a plan view of the device for opening/closing a door of FIG. 7 in the closed state in which the right side of the door is latched.
Figure 9:
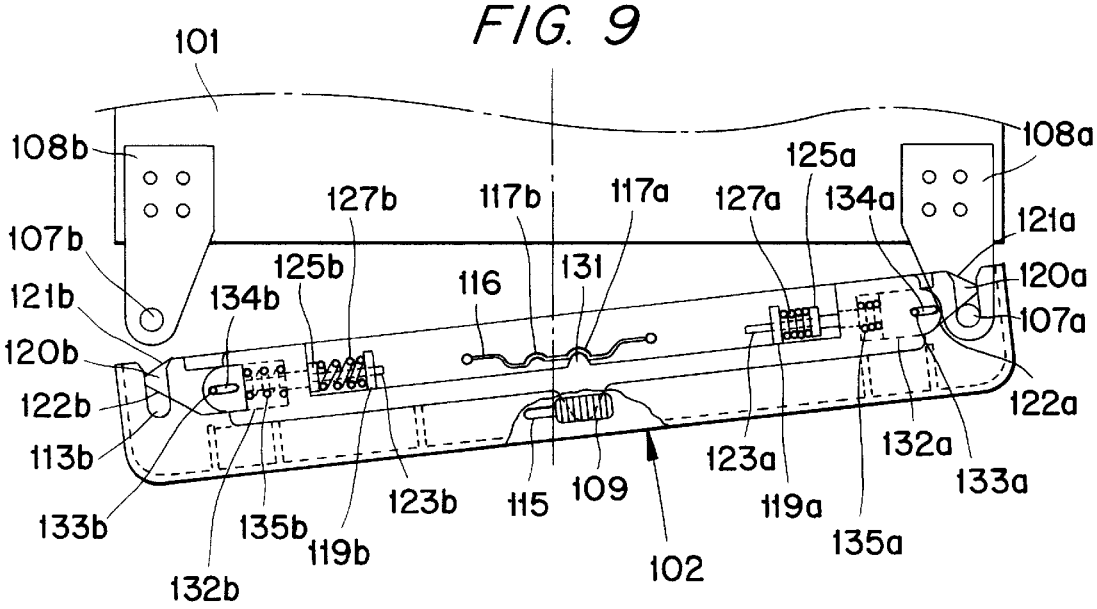
FIG. 9 is a plan view similar to FIG. 8 when the door in FIG. 8 is opened.

FIG. 7 is a partly exploded perspective view of a device for opening/closing a door according to another embodiment of the present invention, FIG. 8 is a plan view of the device for opening/closing a door in which the right side of the door is latched when the door is closed, and FIG. 9 is a plan view of the device for opening/closing a door when the left side of the door is opened.

As shown in the figures and as just as in the previous embodiment shown in FIGS. 2 through 6, the device for opening/closing a door according to this embodiment includes a casing 110 fixed to the upper edge or the lower edge of the door 102 and covered by a cover 111. The casing 110 has pin slots 113*a* and 113*b* positioned near the opposite ends of the casing 110, so that the hinge pins 107*a* and 107*b* of the main body 101 may move into and out of respective pin slots 113*a* and 113*b*.

Pin grippers 120*a* and 120*b* are located in the nearby region respective of pin slots 113*a* and 113*b*. The pin grippers 120*a* and 120*b* restrain perspective hinge pins 107*a* and 107*b* in pin slots 113*a* and 113*b*. The pin grippers 120*a* and 120*b* can slide in the longitudinal direction of the casing 110. The pin grippers 120*a* and 120*b* are elastically urged toward the pin slots 113*a* and 113*b* by springs 127*a* and 127*b* supported by a spring holders 119*a*, 199*b* protruding from the bottom of the casing 110.

The pin grippers 120*a* and 120*b* have respective inclined surfaces 121*a* and 121*b* slanted with respect to the introducing direction of the hinge pins 107*a* and 107*b* in the region of the pin slots 113*a* and 113*b*, and thereby they move backward against the elastic force of the springs 127*a* and 127*b* when the hinge pins 107*a* and 107*b* enter respective pin slots 113*a* and 113*b*. Then, the respective one of the pin grippers 120*a* and 120*b* having moved backward during the introduction of the hinge pins is returned to its initial position by the elastic force of the respective one of the springs 127*a* and 127*b* after the hinge pin has been completely introduced.

The pin grippers 120*a* and 120*b* also have respective inclined surfaces 122*a* and 122*b* in the exiting direction of the introduced hinge pins 107*a* and 107*b*. Therefore, the pin grippers 120*a* and 120*b* perform a corresponding cooperative movement of retraction and returning when the hinge pins 107*a* and 107*b* leave respective pin slots 113*a* and 113*b*.

A latch member 130 having a long bar shape is placed between the pin slots 113*a* and 113*b* and the latch member 130 can slide in its longitudinal direction. The latch member 130 has guide portions 132*a* and 132*b* arranged at the opposite distal ends, and these guide portions 132*a* and 132*b* receive respective pin grippers 120*a* and 120*b* and guide the sliding of the pin grippers 120*a* and 120*b*. The pin grippers 120*a* and 120*b* can slide into respective guide portions 132*a* and 132*b* in the longitudinal direction of the casing 110.

Compression springs 135*a* and 135*b* for urging respective pin grippers 120*a* and 120*b* toward the pin slots 113*a* and 113*b* are interposed between the pin grippers 120*a* and 120*b* and the bottom of the guide portions 132*a* and 132*b*. The compression springs 135*a* and 135*b* urge respective pin grippers 120*a* and 120*b* with a force much smaller than that of the springs 127*a* and 127*b* urging respective pin grippers 120*a* and 120*b* toward the pin slots 113*a* and 113*b* with respect to the casing 110.

The pin grippers 120*a* and 120*b* have respective stopper pins 133*a* and 133*b* protruding transversely with respect to their moving direction. Corresponding to the stopper pins 133*a* and 133*b*, stopper pin slots 134*a* and 134*b* are formed at the guide portions 132*a* and 132*b* of the latch member 130. The stopper pin slots 134*a* and 134*b* extend along the moving direction of respective pin grippers 120*a* and 120*b*. Therefore, the range of movement of the pin grippers 120*a* and 120*b* is limited in respective guide portions 132*a* and 132*b* of the latch member 130.

The latch member 130 is connected through the knob slot 115 to the switching knob 109 which is exposed to the exterior for the user, so that it can be slid by shifting the switching knob 109. The latch member 130 further includes a holding protuberance 131 protruding transversely therefrom. A retaining member 116 is fixed to the casing 110, and the retaining member 116 has two retaining grooves 117*a* and 117*b* for engaging with the holding protuberance 131. The retaining member 116 is made of an elastic material having a shape of a plate.

When the latch member 130 is moved longitudinally by operating the switching knob 109, the retaining member 116 is elastically deformed, so that the holding protuberance 131 of the latch member 130 can be selected to be received in either one of the two retaining grooves 117*a* and 117*b*. The retaining member 116 yieldably prevents the latch member 130 from moving.

In FIG. 8, when the latch member 130 is moved to the right by shifting the switching knob 109 when the door 102 is closed, the holding protuberance 131 is received in the right retaining groove 117*a* of the retaining member 116, and accordingly, the stopper pin 133*a* fixed to the pin gripper 120*a* contacts the inner end of the stopper pin slot 134*a* of the latch member 130. Therefore, the pin gripper 120*a* can not move inward in the longitudinal direction of the casing 110, thereby being maintained to restrain the hinge pin 107*a*. In this case, the compression spring 135*a* urges the pin gripper 120*a* toward the pin slot 113*a*, thereby assuring contact between the stopper pin 133*a* and the inner end of the stopper pin slot 134*a* even when the parts become worn.

FIG. 8 shows a state in which the latch member 130 is moved to the right and then it latches the right pin gripper 120*a* accommodating the pin lest it should move. In this case, the right pin gripper 120*a* can not move away from the pin slot 113*a*. While on the other side, the left pin gripper 120*b* can freely move, and thereby the corresponding hinge pin 107*b* has free access thereto. In other words, the right side of the door 102 continues to maintain the hinge state, while the left side of the door 102 can be freely opened and closed. Therefore, the left side of the door 102 can be switched between the closed state as shown in FIG. 8 and the opened state as shown in FIG. 9, while the right side functions as only a hinge and thereby it can not be opened.

Figure 10:
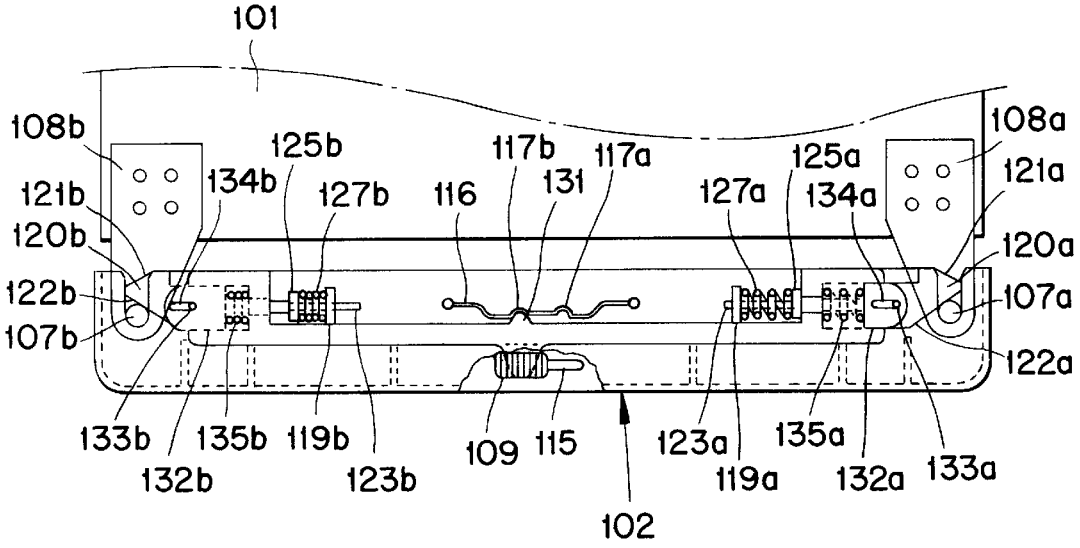
FIG. 10 is a plan view similar to FIG. 8 in the closed state in which the left side of the door is latched.
Figure 11:
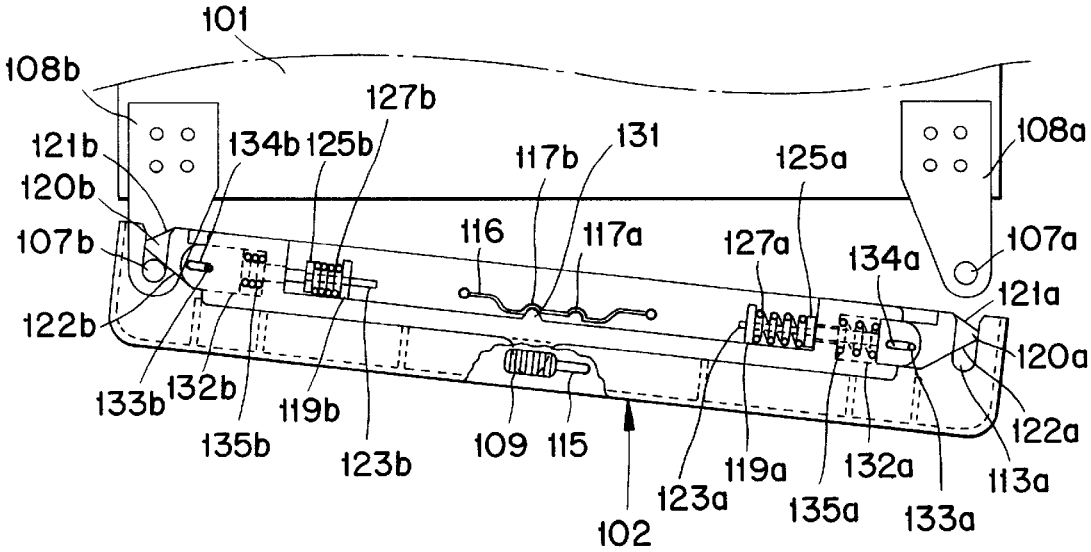
FIG. 11 is a plan view similar to FIG. 10 when the door in FIG. 10 is opened.

FIGS. 10 and 11 show an open state and a closed state in which the latch member 130 is moved to the left and then it latches the left pin gripper 120*b*. In this case, inversely to the case of FIGS. 8 and 9, the right side can be freely opened and closed, while the left side functions as a hinge.

As can be seen from the above described construction of the present embodiment, a user can choose a desired opening direction by moving the latch member 130 toward the desired hinge side by means of the switching knob 109 while the door is closed. When the door is opened, the pin gripper is at the position at which it waits to receive the pin, and thereby the latch member can not be moved toward the opened side and can not be engaged with the engaging face of the pin gripper. Thus, the latch at the side serving as a hinge can not be released, and accordingly the hinge can be securely prevented from being released when the door is opened.

As described above, the present invention provides a device for opening/closing a door which can be selected to be opened from either side of the door and which has a simple and cost efficient construction.

What is claimed is:

1. In combination, a body, a door connected to the body and including a fixed handle structure for opening the door, and a door-securing mechanism enabling the door to be opened selectively at either side thereof while an opposite side forms a hinge, the door-securing mechanism comprising:

a pair of hinge pins disposed on one of the body and door and disposed at respective opposite sides thereof for defining spaced apart axes, respectively;

a pair of pin slots carried by the other of the body and door and disposed on opposite sides thereof for receiving the hinge pins when the door is closed;

a pair of pin grippers mounted on the other of the body and door adjacent the pin slots, each pin gripper being movable between a release state permitting one of the hinge pins to enter and leave its respective pin slot, and a retaining state preventing the one of the hinge pins from leaving the respective pin slot so as to form a hinge axis for the door;

a latch comprising a bar having opposite ends disposed adjacent respective pin grippers and being movable alone a longitudinal axis of the bar between a first position maintaining one of the pin grippers in its release state and the other pin gripper in its retaining state, and a second position maintaining the one of the pin in the retaining state and the other pin gripper in the release state:

a retainer for releasably securing the latch in each of the first and second positions; and a manually movable switching knob operably connected to said bar for actuating said bar, said knob being exposed for actuation by a user when the door is closed.

2. The combination according to claim 1 wherein the retainer is elastically flexible and yieldably engages the bar by a protuberance and slot connection in each of the first and second positions of the bar.

3. The combination according to claim 1 wherein each pin gripper has a pin-receiving groove and is pivotally mounted about a pivot axis extending parallel to its respective hinge pin for pivoting movement between first and second positions defining its release and retaining states, respectively, and a spring biasing each of the pin grippers to its first position; the latch preventing the pin grippers from pivoting to its first position.

4. The combination according to claim 3 wherein the latch comprises a bar having opposite ends disposed adjacent the pin grippers, and being slidable along its longitudinal axis between first and second positions for contacting a selected one of the pin grippers and to hold the one of the pin grippers in the retaining state.

5. The combination according to claim 1 wherein each of the pin grippers are spring-biased toward a first position defining the retaining state and includes two inclined cam follower faces arranged to be contacted by the one of hinge pins as the one of the pins moves into and from the respective pin slot for urging the one of the pin grippers to the release state, the latch preventing the other pin gripper from moving to the release state.

6. The combination according to claim 5 wherein the door-securing mechanism further includes two springs for biasing each of the pin grippers to its first position, each spring acting between its respective pin gripper and the bar, the bar serving to bottom-out one of the springs in each of said first and second position of the bar for preventing movement of each of the pin grippers to its second position.

7. The combination according to claim 1 wherein the door-securing mechanism further comprises a casing fixed to the other of the body and door for forming the pin slots.

8. The combination according to claim 1 wherein the hinge pins are mounted on the body and the pin slots are carried by the door.

9. The combination according to claim 1 wherein the body comprises a refrigerator.

10. The combination according to claim 1 wherein the spaced apart axes extend vertically, and the door swings open in a horizontal direction, each of said pin slots being open in a horizontal direction for receiving one of said hinge pins in the horizontal direction.

11. The combination according to claim 1 wherein the hinge pins are immovably fixed to the one of the body and door.

* * * * *